US005651684A

United States Patent [19]

Northey et al.

[11] Patent Number: 5,651,684

[45] Date of Patent: Jul. 29, 1997

[54] VACUUM PICK UP CAP FOR USE IN MANIPULATING RECEPTACLES

[75] Inventors: William A. Northey, Etters, Pa.; Vincent D. DiMondi, Cary, N.C.; Meng Kuang Kan, Singapore, Singapore

[73] Assignee: Berg Technology, Inc., Reno, Nev.

[21] Appl. No.: 455,330

[22] Filed: May 31, 1995

[51] Int. Cl.[6] ..... H01R 13/60

[52] U.S. Cl. ..... 439/41; 439/940

[58] Field of Search ..... 439/41, 135, 476.1, 439/137, 83, 940

[56] References Cited

U.S. PATENT DOCUMENTS 5,237,739 8/1993 Clark ..... 29/747
5,242,311 9/1993 Seong ..... 439/135
5,249,977 10/1993 Tanaka et al. ..... 439/135
5,361,492 11/1994 Miyazawa ..... 29/879
5,383,797 1/1995 Seong et al. ..... 439/940

*Primary Examiner*—P. Austin Bradley
*Assistant Examiner*—Yong Ki Kim
*Attorney, Agent, or Firm*—Daniel J. Long; M. Richard Page

[57] ABSTRACT

Disclosed is a vacuum pick up cap for use with receptacles. This vacuum pick up cap has a planer top section which is adapted to be engaged by a vacuum nozzle and a lower section from which a plurality of pegs project to engage apertures in the top surface of the receptacle. These pegs have upper and lower longitudinal sections having different axial dimensions so as to be engageable with receptacles having different size apertures. These upper and lower sections may also have longitudinal axes which are laterally displaced from each other to enable the cap to be used on receptacles having rows of apertures which are displaced at different distances.

21 Claims, 4 Drawing Sheets

VACUUM PICK UP CAP FOR USE IN MANIPULATING RECEPTACLES

BACKGROUND OF INVENTION

1. Field of the Invention: The present invention relates to electrical connectors and more particularly to devices used in the manipulation of such connectors during the assembly of electrical and electronic devices.

2. Brief Description of Prior Developments: Electronic components are often manipulated for positioning on electrical apparatus as, for example, on a printed wiring board by means of vacuum suction nozzles. In the case of receptacles, vacuum pick up is typically facilitated by means of caps which have a flat upper surface and lower surface from which projections extend downwardly to engage the apertures on the upper surface of the receptacle. Typically the axial dimensions of such projections will be selected in view of the width of the receptacle apertures which they are intended to engage.

A problem, however, exists with this method of vacuum pick up in that a particular design of vacuum pick up cap will often be useful only with a limited number of types of receptacles. A manufacturer will, therefore, often have to keep a variety of different types of vacuum pick up caps in stock if he wishes to be assured of having an appropriate type of vacuum pick up cap for each of the receptacles with which he may be working.

A need, therefore, exists for vacuum pick up caps which may be used in a large variety of types of receptacles.

SUMMARY OF THE INVENTION

The present invention comprises a cover for use in transporting receptacles by vacuum suction means. This cover includes a top section with a flat upwardly facing surface adapted for engagement by a vacuum nozzle. Extending downwardly from this top section are plurality of projections or pegs which are adapted to fit inside apertures on the top surface of a receptacle and engage these apertures by means of an interference fit. These pegs have an upper longitudinal section and a lower longitudinal section and the axial dimension of the upper section is different from and ordinarily greater than that of the lower section. It will, therefore, be possible to engage an aperture on a receptacle having a relatively small width with the lower section while at the same time the same vacuum pick up cap will be capable of engaging a receptacle having a relatively wider width with the upper section. Within the scope of the present invention, the upper and lower longitudinal sections of the pegs may also have either common or spaced parallel longitudinal axes. When such axes are laterally displaced from each other, it will be possible to engage a number of types of receptacles which are different in that their surface apertures are displaced at different lateral dimensions from each other.

BRIEF DESCRIPTION OF THE DRAWINGS

The vacuum pick up cap of the present invention is further described with reference to the accompanying drawings in which.

DETAILED DESCRIPTION OF THE PREFERRED EMBODIMENTS

Figure 1:
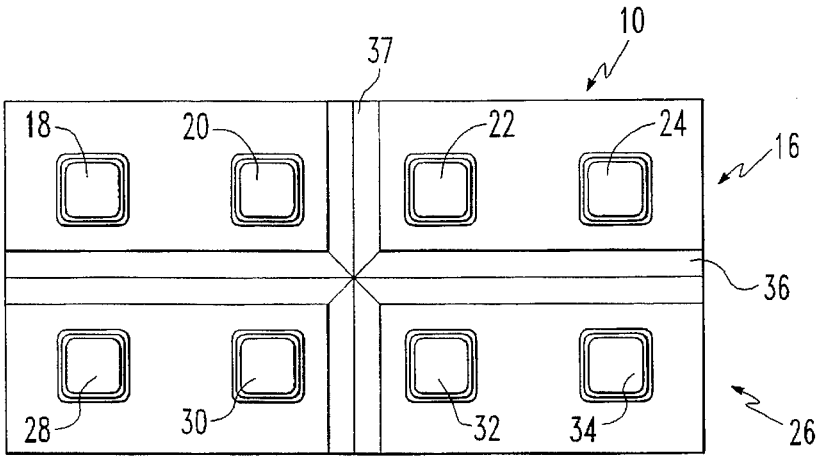
FIG. 1 is a bottom plan view of a preferred embodiment of the vacuum pick up cap of the present invention.
Figure 2:
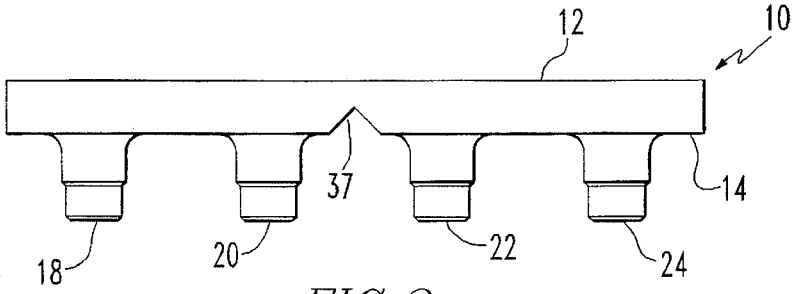
FIG. 2 is a side elevational view of the vacuum pick up cap shown in FIG. 1.
Figure 3:
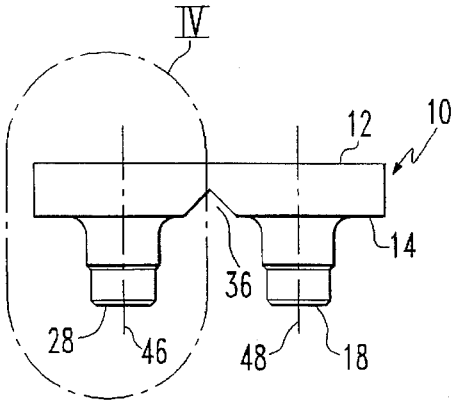
Figure 4:
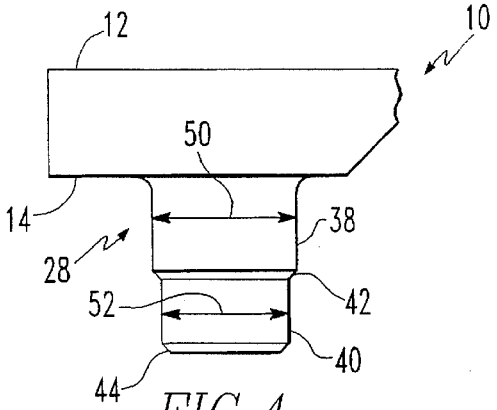
FIG. 4 is a detailed view within the area of area IV in FIG. 3.

Referring to FIGS. 1–4, the first preferred embodiment of the vacuum pick up cap of the present invention includes a top section shown generally at numeral 10. This top section has an upper planar vacuum pick up surface 12 and an opposed projection surface 14. Extending from this opposed projection surface is a row of projections shown generally at numeral 16 which is made up of pegs 18, 20, 22 and 24. There is also a second row of projections shown generally at numeral 26 which is made up of pegs 28, 30, and 34. It will also be noted that there is also a medial longitudinal groove and a transverse groove 37. Referring particularly to FIG. 4, it will be seen that peg 28 has an upper longitudinal section 38, a lower longitudinal section 40, a medial slope section 42 and a lower slope section 44. Referring particularly to FIG. 3, it will be seen that the upper and lower longitudinal sections of peg 28 have a common longitudinal axis 46. It will be understood that all the other pegs have similar upper and lower longitudinal sections and these pegs all have common longitudinal axes as is, for example, shown at numeral 48 in peg 24. Referring again particularly to FIG. 4, it will be seen that these upper and lower longitudinal sections have different axial dimensions as at 50 in the upper section and 52 in the lower section where the axial dimension of the upper section is greater and is adapted to be engaged with a relatively larger aperture in the receptacle while the axial dimension in the lower section is relatively smaller and adapted to be engaged with a relatively smaller aperture in a receptacle.

Figure 6:
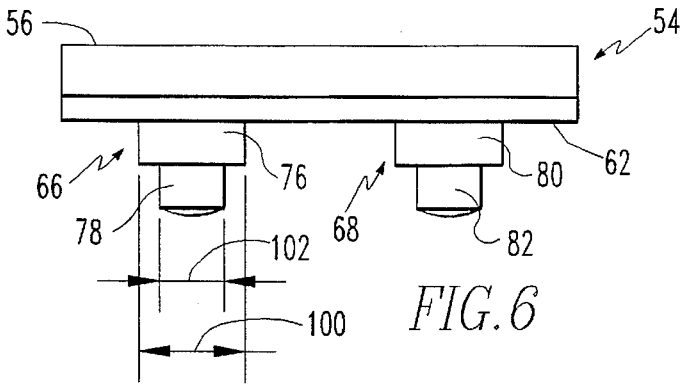
FIG. 6 is a side elevational view of the vacuum pick up cap shown in FIG. 5.
Figure 5:
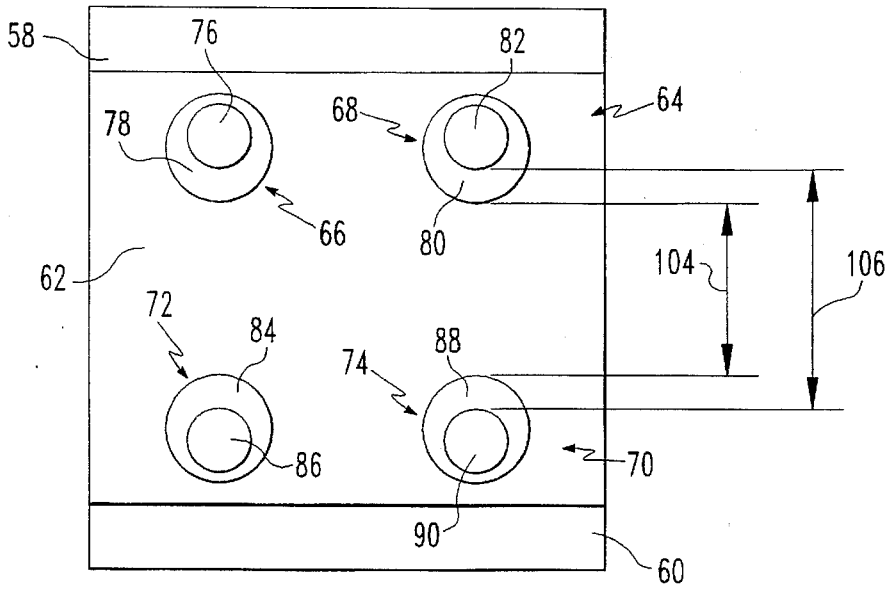
FIG. 5 is a bottom plan view of a second preferred embodiment of the vacuum pick up cap of the present invention.
Figure 7:
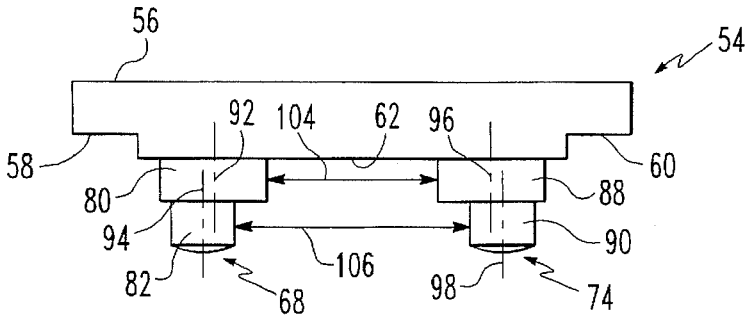
FIG. 7 is an end view of the vacuum pick up cap shown in FIG. 5.

Referring to FIGS. 5–7, another vacuum pick up cap is shown which has a top surface generally at numeral 54. This top surface has an upper pick up surface 56, opposed ledges 58 and 60 and a lower projection surface 62. Extending from this lower projection surface are a row of pegs shown generally at 64 and including peg 66 and 68 and a second row of pegs shown generally at 70 which includes pegs 72 and 74. Peg 66 includes an upper longitudinal section 76 and a lower longitudinal section 78. Peg 68 includes a wider upper longitudinal section 80 and a narrower lower longitudinal section 82. Peg 72 includes an upper longitudinal section 84 and a lower longitudinal section 86, and peg 74 includes an upper longitudinal section 88 and a lower longitudinal section 90. Unlike the vacuum pick up caps described in connection with the first preferred embodiment, in this embodiment of the vacuum pick up cap of this invention the longitudinal axes of the upper and lower sections are not colinear. Referring particularly to FIG. 7, it will, for example, be seen that the longitudinal axes of the upper and lower sections of peg 66 shown respectively at 92 and 94 are parallel and laterally displaced from each other. Similarly the longitudinal axes of the upper and lower sections of peg 74 shown respectively at 96 and 98 are parallel and laterally displaced from each other such that the axes of the upper sections are closer to each other than are the axes of the lower sections. By reason of this configuration, it is possible to engage receptacles having two rows of apertures which are displaced from one another at different distances. It will be noted that the axial dimension as at 100 of the upper longitudinal section is greater than the axial dimension 102 of the lower longitudinal section. It will also be noted that the lateral distance as at 104 between the upper longitudinal section of opposed pegs in rows 62 and 70 is less than the lateral distance 106 between the lower longitudinal sections of opposed pins in these rows.

Figure 8:
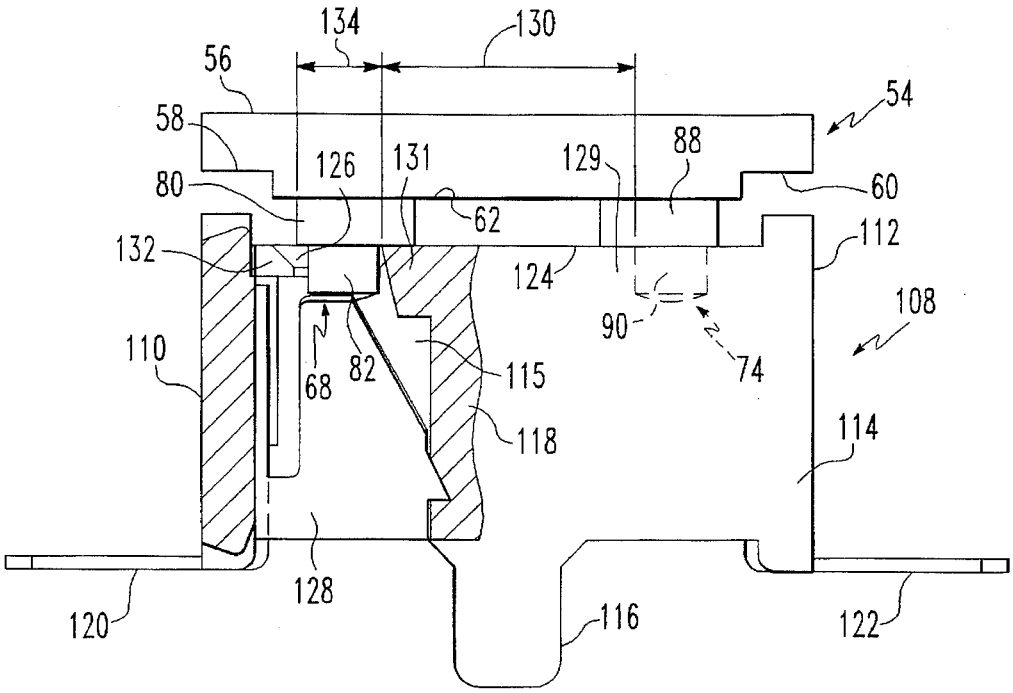
FIG. 8 is a cut away end view showing the vacuum pick up cap shown in FIGS. 5–7 engaged with a receptacle.

Referring to FIG. 8, for example, vacuum pick up cap 54 is shown engaging a receptacle shown generally at 108. This receptacle has opposed side walls 110 and 112 and end walls as at 114 and 115. Extending from this end wall is a locating feature 116 and a medial wall 118 extends between the two end walls. Extending laterally outwardly from the lateral walls are terminals as at 120 and 122. Extending through the top surface 124 are apertures as at 126 which expose receptacle contacts as at 128. It will be understood that this aperture 126 is one aperture in a row of apertures which extends generally parallel to the side walls of the receptacle from one end wall to the other. Another aperture 129 is shown engaged by the lower section 90 of peg 74. This aperture is part of another row of apertures which is parallel to the row which includes aperture 126. The apertures 126 and 129 and their respective rows of apertures are laterally displaced by distance 130. The lateral distances as at 106 (FIG. 5) between the lower longitudinal sections as at 82 and 90 in rows 64 and 70 are selected to be compatible with the lateral distance as at 130 between the rows of apertures. Extending from the medial wall is a ledge 131 and extending from the side wall is another protrusion 132. The space between these protrusions defines an aperture axial dimension 134. The vacuum pick up cap 54 is superimposed over the receptacle such that its upper surface is positioned to receive a vacuum pick up nozzle and the pegs extend from the lower surface so that each peg extending therefrom is received in an aperture in the receptacle. The ledges are spaced vertically above the lateral walls of the receptacle. The axial dimension of the lower longitudinal section of the peg is adapted to be compatible with the axial dimensions as at 134 of the apertures.

Figure 9:
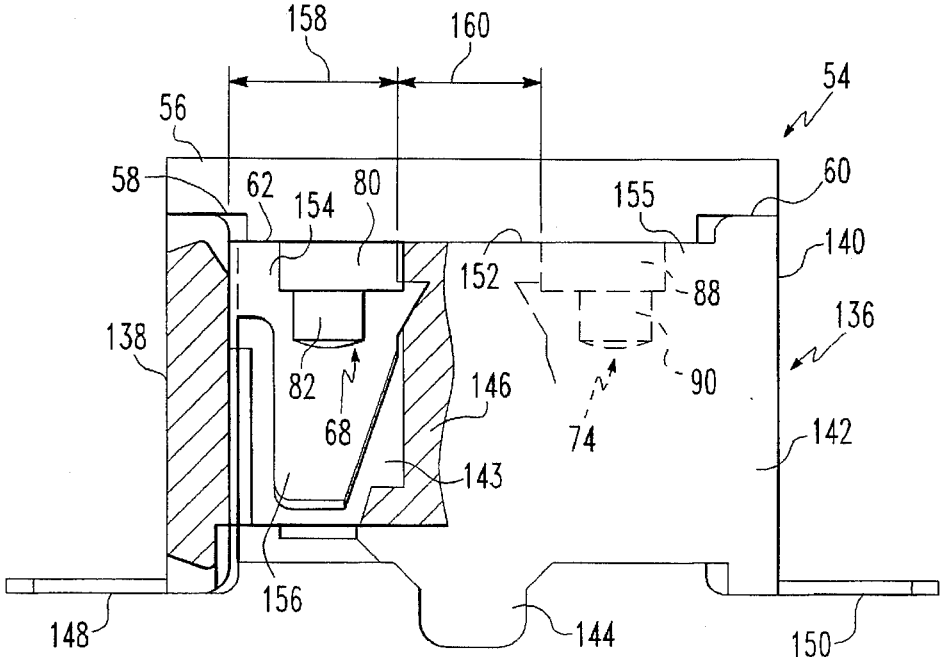
FIG. 9 is a cut away end view of the receptacle shown in 5–7 with a different receptacle.

Referring to FIG. 9, the same vacuum pick up cap 54 is shown engaged with a different receptacle shown generally at numeral 136. This receptacle has side walls 138 and 140 and end walls 142 and 143. Extending downwardly from the end wall is locating feature 144 and extending between the end walls is internal medial wall 146. Projecting outwardly from the side walls are terminals as at 148 and 150. On the top surface 152 there are a plurality of apertures as at 154 and 155. There are also receptacle contacts as at 156 and the spaces between the medial wall and the side walls define an aperture axial dimension 158. It will be observed that the same vacuum pick up cap as engages receptacle 108 will also engage this receptacle 136. In this case while the upper surface is oriented to be engaged by the vacuum nozzle, the lower surface 62 abuts the end wall and the ledges 58 and 60 abut the side walls. The upper axial dimension of the upper longitudinal section is also adapted to engage the wider apertures in this receptacle. Further, the laterally closer longitudinal axes of the upper longitudinal sections enable the closely spaced apertures 154 and 155 to be engaged respectively by the upper longitudinal sections 80 and 88 of pegs 68 and 70. The lateral distances as at 104 (FIG. 5) between these upper longitudinal sections of opposed pegs in the rows 62 and 70 is selected to be compatible with lateral distances as at 160 between apertures in opposed positions of the parallel rows of apertures on the upper surface of the receptacle.

Figure 10:
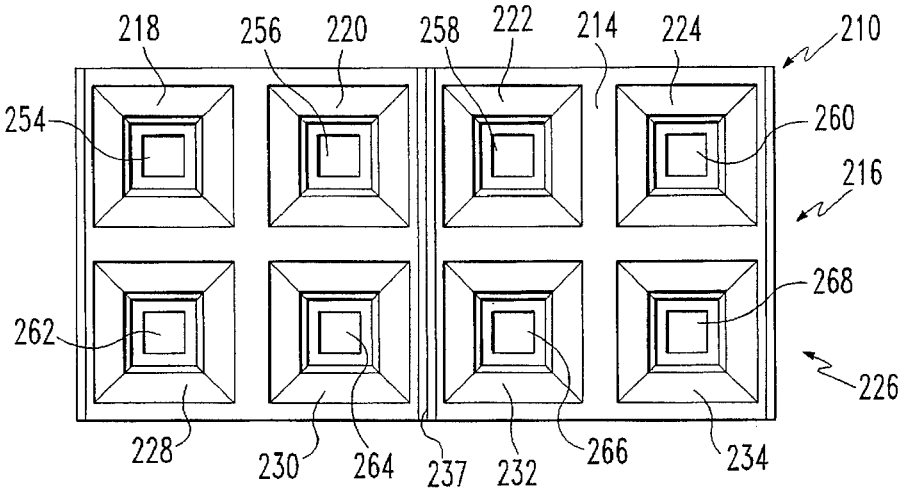
FIG. 10 is a bottom plan view of a third preferred embodiment of the vacuum pick up cap of the present embodiment.
Figure 11:
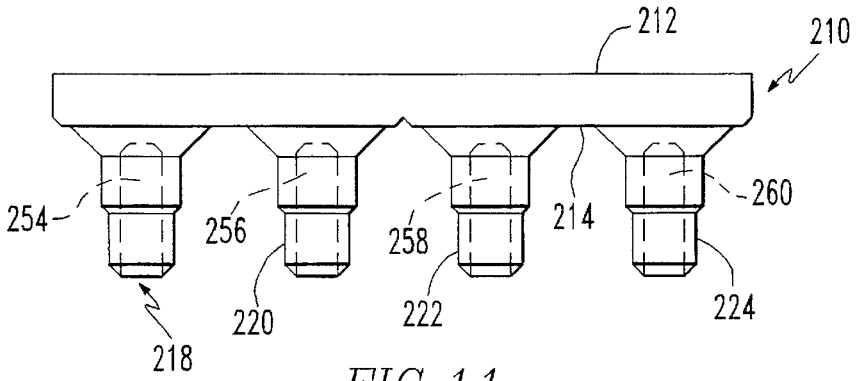
FIG. 11 is a side elevational view of the vacuum pick up cap shown in FIG. 10.
Figure 12:
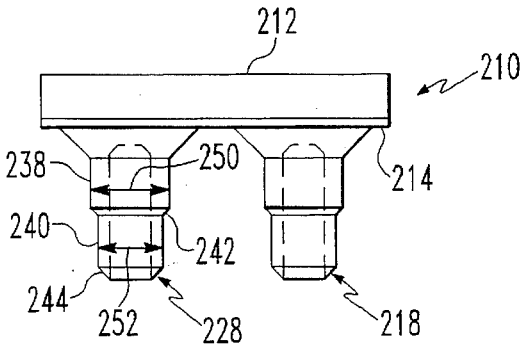
FIG. 12 is an end view of the vacuum pick up cap shown in FIG. 10.

Referring to FIGS. 10–12, the third preferred embodiment of the vacuum pick up cap of the present invention includes a top section shown generally at numeral 210. This top section has an upper planar vacuum pick up surface 212 and an opposed projection surface 214. Extending from this opposed projection surface is a row of projections shown generally at numeral 216 which is made up of pegs 218, 220, 222 and 224. There is also a second row of projections shown generally at numeral 226 which is made up of pegs 228, 230, 232 and 234. It will also be noted that there is a medial transverse groove 237. Referring particularly to FIG. 12, it will be seen that peg 228 has an upper longitudinal section 238, a lower longitudinal section 240, a medial slope section 242 and a lower slope section 244. Referring particularly to FIG. 12, it will be seen that these upper and lower longitudinal sections have different axial dimensions as at 250 in the upper section and 252 in the lower section where the axial dimension of the upper section is greater and is adapted to be engaged with a relatively larger aperture in the receptacle while the axial dimension in the lower section is relatively smaller and adapted to be engaged with a relatively smaller aperture in a receptacle. In each of the pegs 218, 220, 222 and 224 in row 216 there is a central axial recess shown respectively at 254, 256, 258 and 260. In each of the pegs 228, 230, 232 and 234 in row 226 there is a central axial recess shown respectively at 262, 264, 266 and 268. These recesses are adapted in size to engage a pin on a header by interference fit. Consequently this vacuum pick up cap has the capability to be used to engage and manipulate a header by engaging a pin on the header in each of its recesses and lifting the entire assembly by application of a vacuum suction on surface 212. As was described above in connection with the first two embodiments, this vacuum pick up cap also can engage two types of receptacles having apertures of different dimensions by engaging either the upper or the lower longitudinal sections of the pegs with the side walls of the apertures.

It will appreciated that there has been described a vacuum pick up cap which is adapted to efficiently and inexpensively engage a variety of types of receptacles which may vary in the axial dimensions of their upper surface apertures and by the lateral spacing of such apertures.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A cover for use in transporting receptacles by vacuum suction, which receptacles comprise a dielectric housing, having an-upper surface terminals mounted on the housing and at least one aperture in said upper surface, said cover comprising an upper section including a smooth trip surface, at least one projection extending downwardly from the top section to engage said aperture in the receptacle and said projection has an upper longitudinal section having an upper axial dimension and a lower longitudinal section having a lower axial dimension and said upper axial dimension is greater than said lower axial dimension.

2. The cover of claim 1 wherein there are a plurality of projections and each of said projections has an upper longitudinal section having an upper axial dimension and a lower longitudinal section having a lower axial dimension and said upper axial dimension is greater than said lower axial dimension.

3. The cover of claim 2 wherein there are a plurality of apertures and each of said projections aligns with one of said apertures.

4. The cover of claim 3 wherein the projections are arranged in at least one row.

5. The cover of claim 4 wherein the apertures are arranged in at least one row.

6. The cover of claim 5 wherein the projections are arranged in a plurality of rows each of which rows contains a plurality of projections.

7. The cover of claim 6 wherein the apertures are arranged in a plurality of rows each of which rows contains a plurality of apertures.

8. The cover of claim 2 wherein each of the apertures has an axial dimension and said axial dimensions are compatible with the upper axial dimensions of the projections.

9. The cover of claim 2 wherein the aperture has an axial dimension and said axial dimension is compatible with the lower axial dimension of the projection.

10. The cover of claim 2 wherein the upper and lower longitudinal sections of the projections are coaxial.

11. The cover of claim 6 wherein the upper and lower longitudinal sections are the projections are not coaxial.

12. The cover of claim 11 wherein there is a lateral distance between the rows of apertures in the receptacles and a lateral distance between the upper longitudinal sections of the projections and said lateral distance between the upper longitudinal sections is selected to be compatible with said lateral distance between the rows of apertures.

13. The cover of claim 11 wherein there is a lateral distance between the rows of apertures in the receptacles and a lateral distance between the lower longitudinal sections of the projections and said lateral distance between the lower longitudinal sections is selected to be compatible with said lateral distance between the rows of apertures.

14. The cover of claim 1 wherein there is a medial axial recess in at least some of the projections.

15. The cover of claim 14 wherein each of the recesses is adapted in size to engage a pin on a header.

16. The cover of claim 15 wherein the cover is adapted to engage both receptacles and headers.

17. A cover for use in transporting a receptacle and a header by vacuum suction, which receptacle comprises a dielectric housing, having an upper surface, terminals mounted on the housing and at least one aperture in said upper surface and said header comprises a dielectric housing, terminals mounted on the housing and pins arranged in an array or said cover comprising an upper section including a smooth top surface, at least one projection extending downwardly from the top section to be engageable with said aperture in the receptacle and said projection having an axial medial recess to be engageable with one of said pins in the header array.

18. The cover of claim 17 wherein there are a plurality of projections and each of said projections has an axial medial recess which is engageable with one of said pins in the header array.

19. The cover of claim 18 wherein there are a plurality of apertures and each of said projections aligns with one of said apertures.

20. The cover of claim 18 wherein each of the axial medial recesses aligns with one of said pins in the array.

21. In combination a receptacle comprising a dielectric housing with an upper surface and opposed side walls, terminals extending outwardly from said side walls and at least one aperture and a cover comprising an upper section including an upper surface adapted to be engaged by vacuum pick up and a lower surface from which at least one projection having an upper longitudinal section and a lower longitudinal section extends downwardly and said cover being vertically superimposed over said receptacle such that the aperture on the top surface of the receptacle is engaged by one of said upper longitudinal sections of the projection.

* * * * *